United States Patent [19]

Hayashi et al.

[11] Patent Number: 4,527,377

[45] Date of Patent: Jul. 9, 1985

[54] WASHING DEVICE IN A CONTAINER SEALING APPARATUS

[75] Inventors: Masayuki Hayashi; Masatoshi Suzuki, both of Nagoya, Japan

[73] Assignee: Mitsubishi Jukogyo Kabushiki Kaisha, Tokyo, Japan

[21] Appl. No.: 395,303

[22] Filed: Jul. 6, 1982

[51] Int. Cl.[3] ..... B65B 65/00

[52] U.S. Cl. ..... 53/167; 53/328; 141/90; 141/91

[58] Field of Search ..... 53/328, 167; 141/90, 141/91

[56] References Cited

U.S. PATENT DOCUMENTS

| | | | |
|---|---|---|---|
| 2,132,424 | 10/1938 | LeFrank | 141/91 |
| 2,656,966 | 10/1953 | McDonough | 141/91 |
| 3,430,639 | 3/1969 | Roberts | 141/91 X |
| 4,024,896 | 5/1977 | Ishioka | 141/90 |
| 4,389,833 | 6/1983 | Knabe | 53/328 |

FOREIGN PATENT DOCUMENTS

| | | | |
|---|---|---|---|
| 2750233 | 11/1977 | Fed. Rep. of Germany | 141/90 |
| 2739742 | 3/1979 | Fed. Rep. of Germany | 141/90 |
| 1233356 | 5/1971 | United Kingdom . | |

*Primary Examiner*—John Sipos

*Attorney, Agent, or Firm*—Wenderoth, Lind & Ponack

[57] ABSTRACT

An improved washing device in washing a sealing portion of an apparatus for sealing a container such as a bottle includes a washing cap adapted to be detachably mounted to a bottom of a sealing plunger of the sealing apparatus, and a washing liquid circulating device for circulating a washing liquid to portions of the sealing plunger to be washed by the intermediary of the washing cap.

4 Claims, 7 Drawing Figures

WASHING DEVICE IN A CONTAINER SEALING APPARATUS

BACKGROUND OF THE INVENTION

The present invention relates to a washing device used in a container sealing apparatus such as a crown or cap striking apparatus, a cork striking apparatus, a cap fastening apparatus, etc.

In the following, description will be made of such an known apparatus in the prior art, by way of example, in connection with a crown striking apparatus.

An essential part of a crown striking apparatus in the prior art is illustrated in cross-section in FIG. 1. In this figure, reference numeral 1 designates a throat for striking a corrugated portion of a crown or cap 19 put on the top of a bottle 11, and numeral 2 designates a slider adapted to slide along the inside of a head cylinder 8 while holding the throat 1. The slider 2 is provided with an injection port 2*a* for supply of a washing alcohol liquid 18, a feed port 2*b* for the supply of crowns 19, a shoulder 2*c* and a centering portion 2*d*. Reference numeral 3 designates a stopper-striking head that is slidably supported by the slider 2 via a shoulder 3*a* thereof, and this serves to press down the crown 19 put on the top of a bottle neck. Reference numerals 4 and 5 designate springs which depress the stopper-striking head 3 and the slider 2, respectively, downwardly. Reference numeral 6 designates a rotary body rotatably supported from a fixed shaft 12, and a plurality of stopper-striking plunger units 10 are slidably held by the rotary body 6 at equal circumferential distances. Reference numeral 7 designates a roller provided at an upper portion of each head cylinder 8, and numeral 9 designates a stopper-striking cam formed integrally with the fixed shaft 12 and having a cam groove 9*a* to be engaged by the roller 7 so that the stopper-striking plunger 10 may be moved up and down as the rotary body 6 rotates.

Assuming now that the rotary body 6 is rotated under the condition that a bottle 11 filled with a liquid has been supplied and placed on the rotary body 6 at a position just beneath a stopper-striking plunger 10 and also that a crown 19 has been fed to the illustrated position, then the stopper-striking plunger 10 is lowered as a result of engagement between the roller 7 and the cam groove 9*a*. Thus, centering of the bottle 11 first is effected by means of the centering portion 2*d* of the slider 2, and subsequently the crown 19 is put on the top of the neck of the bottle 11. As the stopper-striking plunger 10 is further lowered, the stopper-striking head 3 abuts against the crown 19 and is lowered no further. The throat 1 however is lowered further as a result of continuous lowering of the stopper-striking plunger 10, so that the corrugations of the crown 19 are pressed to conform to the shape of the neck of the bottle by the action of the throat 1 as urged by the resilient force of the spring 5. When the shoulder 2*c* of the slider 2 abuts against the shoulder 3*a* of the slider 2 lowering of the head 3 stops even if the head cylinder 8 is further lowered. Thus, shrinking or messing of the crown, that is the stopper-striking operation, has been completed. After completion of the stopper-striking operation the stopper-striking plunger 10 will rise and the bottle 11 will be ejected.

During the above-described stopper-striking process, the lower portion of the slider 2 is contaminated by foam produced as a result of foaming of the liquid within the bottle, and the stopper-striking head 3 and the throat 1 are contaminated by paint flakes that have peeled off the crown as a result of shrinking or pressing of the crown.

Accordingly, after daily production has been finished, an operator 17 injects an alcohol liquid 18 through injection port 2*a* by means of an injector 16 to wash and sterilize the lower portions of the throat 1, stopper-striking head 3 and slider 2.

However, with the above-mentioned washing operation, removal of adhered paint flakes is difficult and there remains a problem that satisfactory washing and sterilization is impossible.

A stopper-striking apparatus is the most important apparatus in the final process of sealing bottles and achieving protection of a liquid within the bottles. Hence, unsanitary maintenance of this apparatus implies that the quality of the liquid filled in the bottles would be seriously influenced thereby. Thus, improvements in the apparatus have been strongly desired.

SUMMARY OF THE INVENTION

The present invention has been worked out under developed in view of the above-mentioned background of the art.

It is therefore one object of the present invention to provide a washing device with a container sealing apparatus which can wash and sterilize contaminated portions of a sealing plunger that is required to be washed into a fully satisfactory condition.

According to one feature of the present invention there is provided a washing device is a container sealing apparatus comprising a washing cap adapted to be detachably mounted to a bottom of a sealing plunger in the container sealing apparatus and a washing liquid circulating device for circulating a washing liquid to portions of the sealing plunger to be washed by the intermediary of the washing cap.

Since the washing device for a container sealing apparatus according to the present invention is constructed in the above-featured manner, upon washing the portions in the sealing plunger after completion of production, the washing cap is mounted to the bottom of the sealing plunger, a washing liquid is circulated from the washing liquid circulating device to the portions to be washed in the sealing plunger by the intermediary of the washing cap, and thereby the portions to be washed can be cleaned by a physical action of the flow of the washing liquid, a thermal action of the temperature of the washing liquid and a chemical action of a cleaning material in the washing liquid. Therefore, cleaning and sterilization can be achieved so as to realize a sufficiently clean condition.

BRIEF DESCRIPTION OF THE DRAWINGS

The above-mentioned and other objects, features and advantages of the present invention will become more apparent by reference to the following description of preferred embodiments of the invention taken in conjunction with the accompanying drawings, wherein.

DETAILED DESCRIPTION OF THE INVENTION

Figure 1:
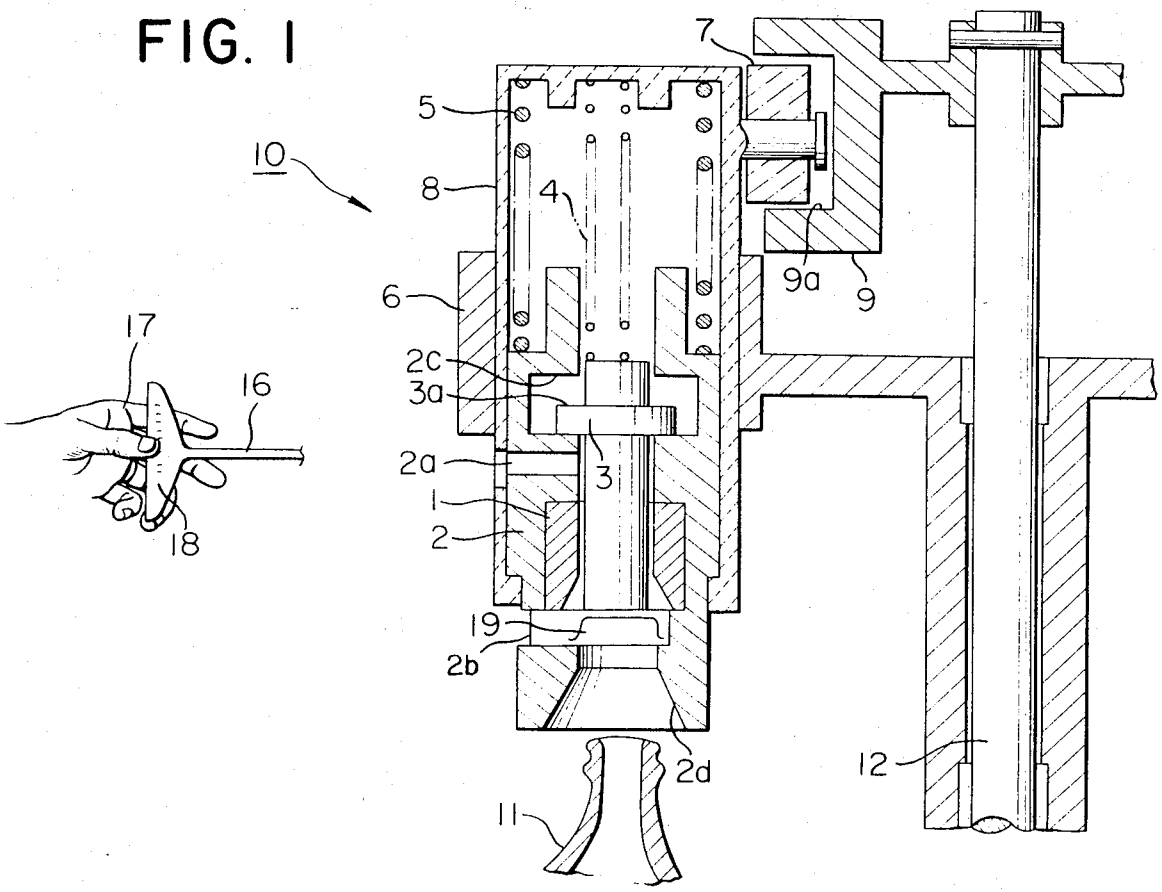
FIG. 1 is a cross-sectional view showing a construction of a crown striking apparatus of the prior art, as well as the manner of washing thereof.
Figure 2:
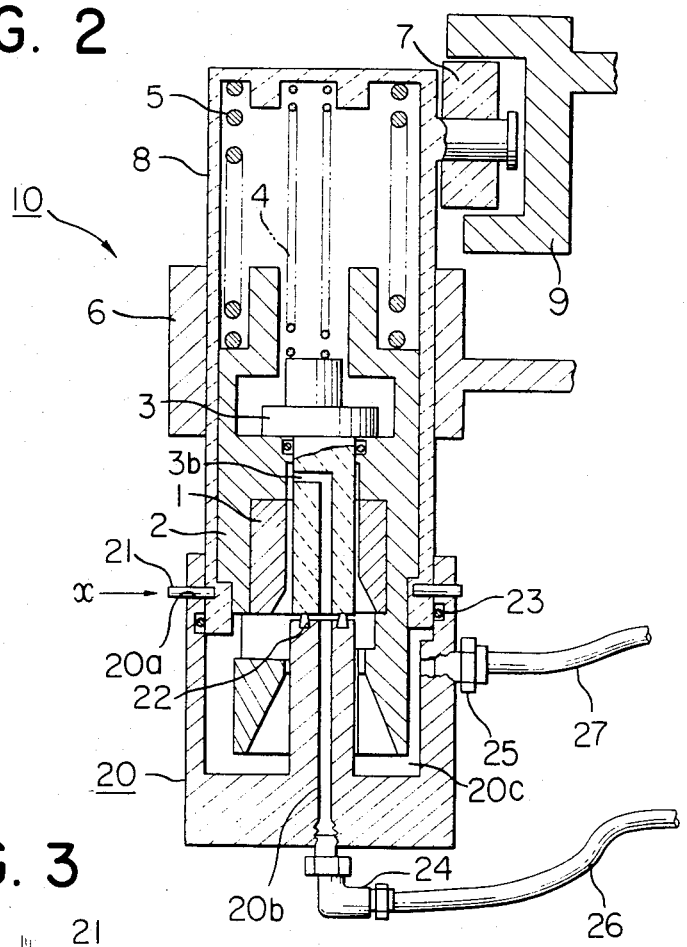
FIGS. 2 to 4 are schematic views showing one preferred embodiment of the present invention, FIG. 2 being a cross-sectional view of only the portion of a stopper-striking plunger, FIG. 3 being a perspective view as viewed in the direction of arrow X in FIG. 2 and FIG. 4 being an overall elevation view.

Now description will be made in greater detail of the preferred embodiments of the present invention illustrated in the drawings. FIG. 2 is a cross-sectional view of a crown or cap striking plunger according to a first preferred embodiment of the present invention, in which reference numerals 1 to 10 designate component parts identical to those of the prior art crown striking apparatus shown in FIG. 1 and given like reference numerals, and they have the function of striking a crown against a bottle neck. What is different from the prior art structure is that a washing liquid passageway 3*b* is provided in the stopper-striking head 3 and that a plurality of pins 21 are provided on the outer circumference of the lower portion of head cylinder 8.

Figure 3:
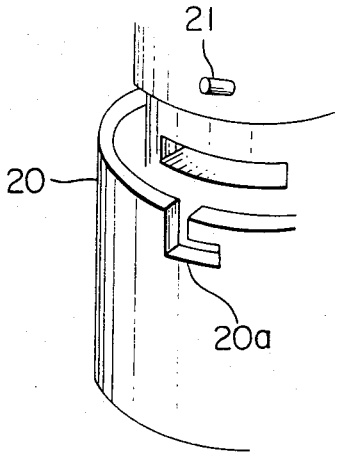

Reference numeral 20 designates a washing cap or chamber member having bayonet slots 20*a* for engaging with the pins 21 as shown in FIG. 3, and which thereby can be detachably mounted on the bottom of the stopper-striking plunger unit 10. In this washing cap 20 are provided a washing liquid passageway 20*b* disposed so as to communicate with the washing liquid passageway 3*b* provided in the stopper-striking head 3 as sealed by a packing 22, and a recessed space or chamber 20*c* in which the bottom portion of the slider 2 fits loosely, and the boundary between the bottom portion of the head cylinder 8 and the washing cap 20 is sealed by means of an O-ring 23.

Figure 4:
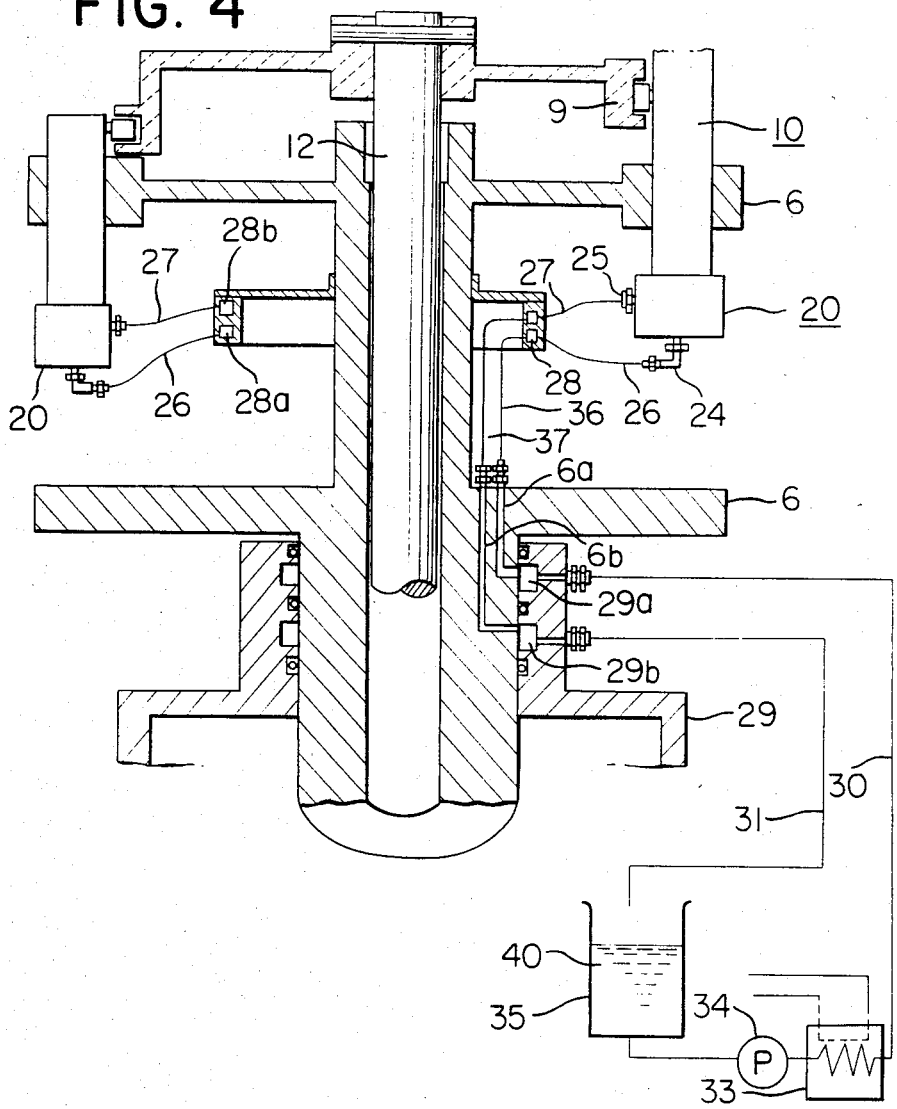

In addition, to the passageway 20*b* and the space 20*c*, respectively, are connected tubes 26 and 27 through tube joints 24 and 25, and as shown in FIG. 4 these tubes 26 and 27 are connected to a lower area 28*a* and an upper area 28*b*, respectively, of a manifold 28. In addition, in rotary body 6 are provided washing liquid passageways 6*a* and 6*b* which communicate via tubes 36 and 37 to the lower area 28*a* and the upper area 28*b*, respectively of the manifold 28, and these passageways 6*a* and 6*b* are communicated with grooves 29*a* and 29*b*, respectively, provided on an inner circumferential surface of a fixed frame 29 as sealed by O-rings. Furthermore, the grooves 29*a* and 29*b* are respectively connected to tubes 30 and 31, and between the free ends of the tubes 30 and 31 are provided a washing liquid heating device 33, a pump 34 and a washing liquid tank 35 so that a washing liquid 40 can be circulated to the stopper-striking plungers 10.

A stopper-striking operation during production in the above-mentioned embodiment is similar to that in the prior art apparatus as described previously, and when production has been finished, a washing operation is carried out. Upon this washing operation, at first the respective washing caps 20 are mounted on all of the plurality of stopper-striking plungers 10 by the engagement between the pins 21 and the corresponding bayonet grooves 20*a*, and thereafter the tubes 26 and 27 are connected between the washing caps 20 and the manifold 28. Subsequently, a washing liquid 40 is filled in the tank 35, and while the stopper-striking apparatus is subjected to idle operation, the pump 34 is started to circulate the washing liquid in the tank 35. The washing liquid delivered from the pump 34 is heated by the heating device 33, and then passes through the tube 30, groove 29*a*, passageway 6*a* and tube 36 into the lower area 28*a* of the manifold 28. Subsequently the liquid is divided from the manifold 28 into the respective tubes 26 connected to the respective washing caps 20 to flow into the respective caps 20 via joints 24.

The washing liquid having flowed into a cap 20 enters the passageway 3*b* within the stopper-striking head 3 through the passageway 20*b*, flows through the spaces within the slider 2 and the throat 1, enters from the bottom of the slider 2 into the recessed space 20*c* in the cap 10, then passes through the tube 27, the upper area 28*b* of the manifold 28, the tube 37, the passageway 6*b*, the groove 29*b* and the tube 31 and returns to the tank 35. By circulating the washing liquid through the above-mentioned route for a predetermined period, the portions within the bottom section of the stopper-striking plunger 10 requiring washing, that is, the bottom portion of the slider 2, the throat 1 and the stopper-striking head 3 are cleaned and sterilized owing to a physical action of a flow velocity of the washing liquid, a thermal action of a high temperature of the washing liquid and a chemical action of a cleaning material in the washing liquid. After completion of the washing operation, the washing liquid is collected, and the washing caps 20 are dismounted to be ready for the next producing operation.

As described above, since provision is made that necessary portions are washed while circulating a high-temperature washing liquid, even contaminations which are difficult to remove can be washed sufficiently owing to a strong cleaning and sterilizing action of the washing liquid, and thus an extremely high cleaning and sterilizing effect can be realized.

Figure 5:
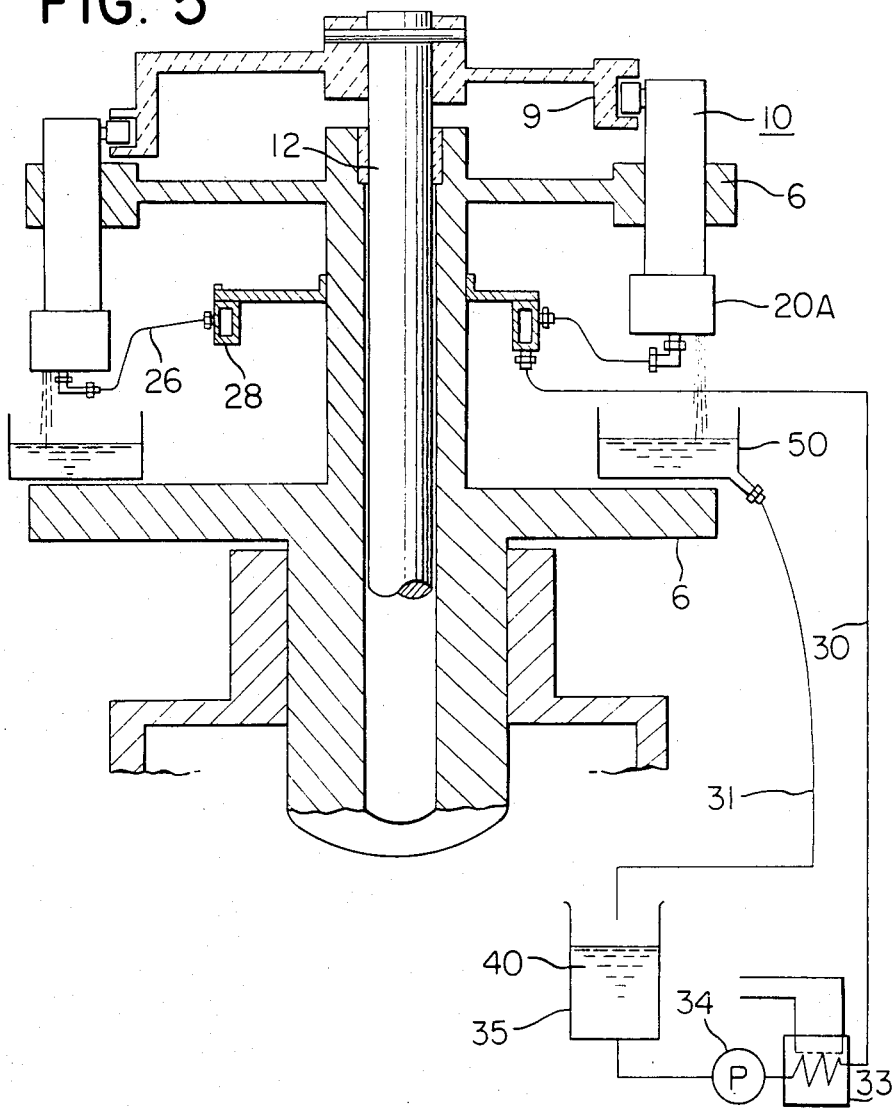
FIGS. 5 and 6 are an overall elevation view and a cross-sectional view of a stopper-striking plunger portion showing another preferred embodiment of the present invention.
Figure 6:
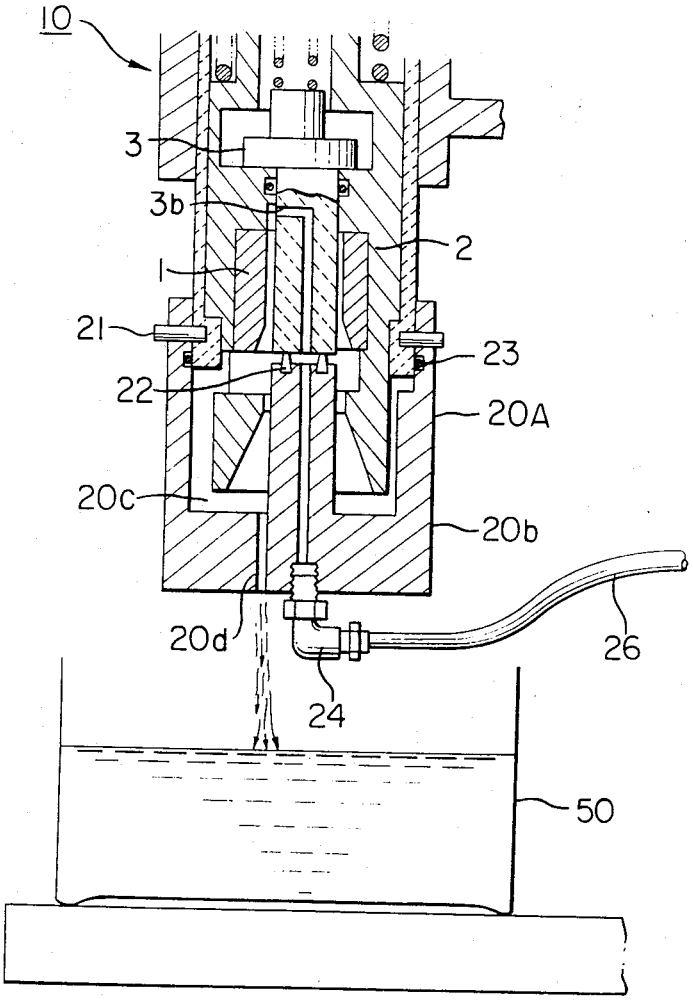

In addition, besides the above-mentioned embodiment, instead of connecting the tube 27 to the cap to return the washing liquid to the tank 35, modification can be made such that a drain hole 20*d* is provided in a cap 20*a*, a drain pan 50 for receiving the washing liquid discharged through the drain hole 20*d* is placed on the rotary body 6 and the washing liquid is returned from the drain pan 50 through a tube 31 to the tank 35 as shown in FIGS. 5 and 6. In this modified embodiment, by circulating the washing liquid by merely starting the pump 34 without operating the stopper-striking apparatus, the necessary portions of the stopper-striking plunger can be washed in a manner similar to the first-described embodiment.

Figure 7:
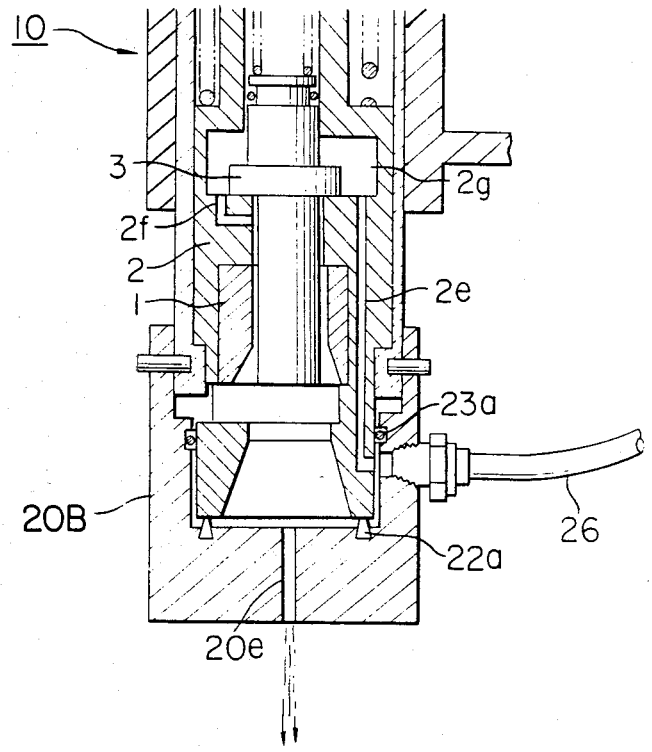
FIG. 7 is a cross-sectional view of a stopper-striking plunger portion showing still another preferred embodiment of the present invention.

Moreover, with regard to the mode of making the washing liquid flow through the interior of the stopper-striking plunger 10, various methods can be conceived, and besides the method employed in the above-described embodiment, for instance, another method can be employed in which washing liquid passageways 2*e* and 2*f* are additionally formed in the slider 2 as shown in FIG. 7, the washing liquid fed through the tube 26 is led via the passageway 2*e* to a chamber 2*g*, then it is made to flow down through the spaces within the slider 2 and the throat 1, and the washing liquid is once stored in a cap 20*b* and then is made to flow out through a drain hole 20*e*. In this modified embodiment, the cap 20B is provided with a packing 22*a* and an O-ring 23*a* at the illustrated positions.

Since many changes could be made in the above construction and many apparently widely different embodiments of this invention could be made without departing the scope thereof, it is intended that all matter contained in the above description or shown in the accompanying drawings shall be interpreted as illustrative and not as limiting the scope of the invention.

What is claimed is:

1. In a container sealing apparatus of the type including a rotary body rotatable about a vertical axis, a plurality of plunger units mounted about said body for rotation therewith, and means for raising and lowering said plunger units during rotation and thereby for moving said plunger units into and out of sealing engagement with respective containers during a production operation, each said plunger unit comprising a head cylinder, a slider mounted for sliding movement within said head cylinder, and a stopper-striking head mounted for sliding movement within said slider, the improvement of means for washing portions of said plunger units during a washing operation after interruption of the production operation, said washing means comprising:

a plunger passageway extending through each said plunger units;

a plurality of washing chamber members adapted to be mounted on the bottoms of respective said plunger units during said washing operation and to be detached therefrom during said production operation;

means for rigidly attaching said washing chamber members to said respective plunger units, such that said washing chamber members are suspended by said respective plunger units; and means for circulating a washing liquid through said washing chamber members into contact with said portions of said plunger units and through said plunger passageways.

2. The improvement claimed in claim 1, wherein said attaching means comprise a plurality of pins fixed to and extending from each said head cylinder, and a plurality of bayonet-like slots formed in each said washing chamber member, said pins being received in said slots and thus rigidly mounting said washing chamber members on said head cylinders during said washing operation.

3. The improvement claimed in claim 1, wherein said circulating means comprises, for each said plunger unit and the respective said washing chamber member, a space between said head and said slider, said plunger passageway comprising a first passageway extending through said head and having one end connected to said space, a second passageway extending through said washing chamber member, said second passageway having a first end connected to a source of washing liquid and a second end sealingly connected to a second end of said first passageway, a chamber in said washing chamber member and connected to said space, and a discharge extending from said chamber through said washing chamber member.

4. The improvement claimed in claim 1, wherein said circulating means comprises, for each said plunger unit and the respective said washing chamber member, a space between said head and said slider, a chamber in said washing chamber member and connected to said space, a passage extending through said slider and having a first end connected to a source of washing liquid and a second end connected to said plunger passageway which is connected to said space, and a discharge extending from said chamber through said washing chamber member.

* * * * *